US009200405B2

(12) United States Patent
Baekelandt et al.

(10) Patent No.: US 9,200,405 B2
(45) Date of Patent: Dec. 1, 2015

(54) CORD HAVING AN IMPROVED ADHESION PROMOTING COATING

(75) Inventors: Tom Baekelandt, Dadizele (BE); Roland Groenen, Horebeke (BE); Kris Van Hege, Ghent (BE)

(73) Assignee: NV BEKAERT SA, Zwevegem (BE)

( * ) Notice: Subject to any disclaimer, the term of this patent is extended or adjusted under 35 U.S.C. 154(b) by 123 days.

(21) Appl. No.: 13/139,615

(22) PCT Filed: Dec. 11, 2009

(86) PCT No.: PCT/EP2009/066937

§ 371 (c)(1), (2), (4) Date: Jun. 14, 2011

(87) PCT Pub. No.: WO2010/069875

PCT Pub. Date: Jun. 24, 2010

(65) Prior Publication Data

US 2011/0250426 A1 Oct. 13, 2011

(30) Foreign Application Priority Data

Dec. 16, 2008 (EP) ..... 08171797

(51) Int. Cl.
*D02G 3/36* (2006.01)
*D02G 3/40* (2006.01)
(Continued)

(52) U.S. Cl.
CPC ..... *D07B 1/0666* (2013.01); *D07B 2201/102* (2013.01); *D07B 2201/104* (2013.01); *D07B 2201/2011* (2013.01); *D07B 2201/2012* (2013.01); *D07B 2201/2013* (2013.01); *D07B 2201/2022* (2013.01); *D07B 2201/2023* (2013.01); *D07B 2201/2024* (2013.01); *D07B 2201/2043* (2013.01);
(Continued)

(58) Field of Classification Search
CPC ..... D07B 1/16; D07B 1/162; D07B 1/168; D07B 1/167; D07B 1/0666; D07B 2201/2045; D07B 2201/2013
See application file for complete search history.

(56) References Cited

U.S. PATENT DOCUMENTS 3,677,809 A * 7/1972 Klement ..... 427/386
6,295,799 B1 * 10/2001 Baranda ..... 57/221
(Continued)

FOREIGN PATENT DOCUMENTS

EP 0 550 005 B1 7/1993
GB 1 466 114 A 3/1977
(Continued)

OTHER PUBLICATIONS

Rupp, J., "Electrostatic Spray Processes", 1999, Elsevier, Metal Finishing, vol. 97, Issue 5, Supplement 1, pp. 208-210, 212-214, 216-224.*

*Primary Examiner* — Jennifer Chriss
*Assistant Examiner* — Frank Vineis
(74) *Attorney, Agent, or Firm* — Foley & Lardner LLP

(57) ABSTRACT

The invention relates to cord (20) comprising a number of filaments twisted together. The peripheral surface of the cord (20) is at least partially coated with an adhesion promoting coating (24). The adhesion promoting coating (24) comprises at least a first layer comprising a silicon based coating, a titanium based coating, a zirconium based coating or a combination thereof. The invention further relates to a composite material comprising such a cord (20) embedded in a polymer material. Furthermore the invention relates to a method to manufacture such a cord (20).

15 Claims, 3 Drawing Sheets

Figure 1A:
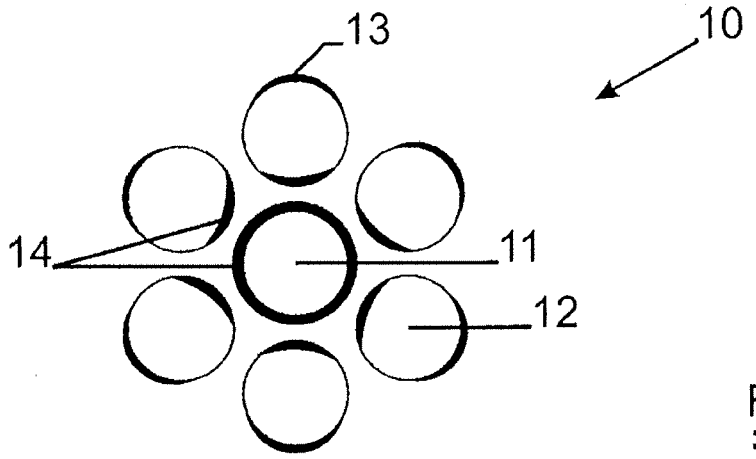
Fig. 1a Prior art

(51) Int. Cl.

| | |
|---|---|
| ***D02G 3/22*** | (2006.01) |
| ***B05D 5/10*** | (2006.01) |
| ***B05D 1/04*** | (2006.01) |
| ***B32B 25/20*** | (2006.01) |
| ***D07B 1/06*** | (2006.01) |
| *D02G 3/02* | (2006.01) |
| *B32B 15/04* | (2006.01) |
| *B32B 15/18* | (2006.01) |
| *B32B 15/08* | (2006.01) |

(52) U.S. Cl.

CPC ..... *D07B 2201/2044* (2013.01); *D07B 2201/2045* (2013.01); *D07B 2201/2059* (2013.01); *D07B 2201/2061* (2013.01); *D07B 2205/20* (2013.01); *D07B 2205/3021* (2013.01); *D07B 2401/2095* (2013.01); *D07B 2501/2046* (2013.01); *Y10T 428/249922* (2015.04)

(56) References Cited

U.S. PATENT DOCUMENTS

| | | | | |
|---|---|---|---|---|
| 2004/0258915 | A1 | 12/2004 | Hasui et al. | |
| 2005/0079364 | A1 * | 4/2005 | van Ooij et al. | 428/447 |
| 2006/0174604 | A1 * | 8/2006 | Vanderbeken et al. | 57/217 |

FOREIGN PATENT DOCUMENTS

| | | | | |
|---|---|---|---|---|
| JP | 54-23758 | A | | 2/1979 |
| JP | 2002-348790 | A | | 12/2002 |
| JP | 2002348790 | A | * | 12/2002 |
| JP | 2008-240140 | A | | 10/2008 |
| WO | WO 2004-076327 | A1 | | 9/2004 |
| WO | WO 2005-014924 | A1 | | 2/2005 |
| WO | WO 2007-020156 | A1 | | 2/2007 |

* cited by examiner

CORD HAVING AN IMPROVED ADHESION PROMOTING COATING

TECHNICAL FIELD

The invention relates to a cord having an improved adhesion promoting coating. The invention also relates to a composite material comprising such a cord and to a method of manufacturing a cord.

BACKGROUND ART

Cords such as steel cords are a preferred reinforcement material for a lot of polymer materials in a high number of different applications. It is known that the adhesion of the steel cords to the polymer material is critical to obtain an interesting composite material. For many applications, adhesion is a critical parameter determining the overall performance of the final composite material. On the other hand corrosion of the steel cord when not protected properly can be a serious problem.

Silane based coatings are known in the art to increase the adhesion between a metal filament or metal cord and a polymer material such as polyvinyl chloride, polyurethane, polyethylene terephthalate, polyacrylate, polypropylene, modified polypropylene, . . . . The silane based coatings known in the art are applied on the metal filament or metal cord by dipping the metal filament or cord in a solution comprising the silane. Alternatively, the silane based coatings known in the art may be applied on the metal filament or metal cord by painting the filament or cord with a solution comprising the silane.

Subsequently, the solvent is evaporated during the drying process and the silane based coating is cured. Finally, the metal filament or cord comprising the silane based coating is embedded in a polymer material.

The adhesion obtained between the metal and the polymer material by this type of silane based coatings is often inadequate. Numerous reasons for this inadequate adhesion can be found.

One reason is the incorrect matching between the functional groups of the silane based coating and the polymer material.

Large amounts of silane based coatings may lead to thick, inhomogeneous coatings resulting in inadequate adhesion.

Also large amounts of silane based coating present in the voids of the cord and at the interfaces between two adjacent filaments may explain the inadequate adhesion. Even after drying and/or curing the amount of silane based coatings present in the voids of the cord and at interfaces between to adjacent filaments is in many cases too high. This can result in cords having poor adhesion performance and in cords suffering from corrosion (white rust formation).

Furthermore, this type of silane based coatings often has a limited hydrolysis resistance. This may cause serious problems for example when the composite material is exposed in a humid environment.

DISCLOSURE OF INVENTION

It is an object of the present invention to provide a cord having an improved adhesion promoting coating assuring an adequate adhesion to a polymer material.

It is another object of the present invention to provide a cord having a controlled quantity of adhesion promoting coating as well as a controlled distribution of adhesion promoting coating.

It is another object of the present invention to provide a cord having an improved hydrolysis resistance.

It is a further object to provide a composite material comprising a cord embedded in a polymer material having an improved adhesion promoting coating.

It is still a further object to provide a method of manufacturing a cord having an improved adhesion promoting coating.

According to a first aspect of the present invention a cord as defined in claim 1 is provided. The cord is partially coated with an adhesion promoting coating.

The cord comprises filaments, preferably steel filaments. Filaments are twisted together to form a cord or a strand.

Strands on their turn can be twisted together to form a cable. For the purpose of the present invention, "cord" means a strand made of filaments or a cable made of such strands.

A "filament" is defined as an individual element in a strand or a cord.

Looking at the cord a series of cross-sections in a plane perpendicular to the axis of the cord can be envisaged. Within such a cross-section adjacent filaments can be discerned. Each pair of adjacent filaments define an interface zone.

For the purpose of this invention "interface zone" is defined as the zone between two adjacent filaments where the distance between these adjacent filaments is the smallest.

With "adjacent filaments" is meant filaments that are in close proximity.

Adjacent filaments may or may not have contact. Generally, the outer surface of adjacent filaments remain within a distance of 500 μm, for example within a distance of 100 μm. Anyway, the term "adjacent filaments" implies the absence of another filament between the adjacent filaments.

Further looking at the cord a peripheral surface of the cord can be observed.

The "peripheral surface" of a cord is defined as the surface of this cord visible by line-of-sight inspection by an observer rotating 360° around this cord in a plane parallel to said cross-sections of this cord.

Filaments of a cord according to the present invention may have edges that are part of the peripheral surface of the cord and/or edges that are not part of the peripheral surface of the cord.

The edges of a filament that are part of the peripheral surface of the cord are called "peripheral edges of a filament" or in short "peripheral edges". The edges of a filament that are not part of the peripheral surface of the cord are called "non-peripheral edges of a filament" or in short "non peripheral edges".

A cord according to the present invention may comprise filaments that have peripheral edges and non-peripheral edges and filaments that only have non-peripheral edges.

Crucial for the cords according to the present invention is that the peripheral surface of the cord is coated with the adhesion promoting coating whereas other parts of the cord (not belonging to the peripheral surface of the cord) are substantially free of the adhesion promoting coating.

This means that the peripheral edges of the filaments are coated with the adhesion promoting coating whereas the non peripheral edges of the filaments are substantially free of said adhesion promoting coating.

Preferably, 100% of the peripheral surface of the cord is coated.

With "substantially free" is meant that accidentally there can be some coating present however the presence of coating material is not present in a structured or systematic way.

The adhesion promoting coating comprises at least a first layer. Possibly, the adhesion promoting coating comprises additional layers such as a second layer, a third layer, . . . .

The adhesion promoting coating has a thickness which may vary depending on the location of the peripheral surface. For the purpose of the present invention the thickness of the adhesion promoting coating is defined as Tx at location x.

Important for a cord according to the present invention is that the thickness Tx of the adhesion promoting coating in an interface zone of adjacent filaments is not higher than the thickness Tx of said adhesion promoting coating at a location of said peripheral surface which is not in an interface zone of adjacent filaments.

This means that there is no accumulation of coating in the interface zone between two adjacent filaments.

The thickness of the adhesion promoting coating is preferably less than 1 μm and is for example ranging between 5 nm and 5000 nm, such as ranging between 5 nm and 1000 nm.

An advantage of a cord according to the present invention is that the adhesion promoting coating is thin. This thin adhesion promoting coating allows a fast drying and curing and finally results in an adequate adhesion with the polymer material.

A further advantage of a cord according to the present invention is that there is no accumulation of coating material at the interface of adjacent materials. As there is no accumulation of coating material at the interfaces fast drying and curing is possible.

As the adhesion promoting coating is thin and as there is no accumulation of coating in the interface zone between adjacent filaments, the presence of the adhesion promoting coating has almost no influence on the distance between adjacent filaments. The gaps between adjacent filaments present in a cord not being coated with the adhesion promoting coating remain present in the cord provided with the adhesion promoting coating. This means that the presence of the adhesion promoting coating will not limit the possible penetration of the polymer material in the cord once the cord is embedded in the polymer material. This is seen as an important advantage compared to other adhesion promoting coatings known in the art.

It is thus an important advantage of a cord according to the present invention that both the quantity of the adhesion promoting coating and the distribution of the adhesion promoting coating over the cord are controlled.

Cords known in the art having a coating applied by dipping the cord in a solution have the drawback that a high amount of coating and/or of residual solvent is present on the filaments and/or at the interface between adjacent filaments and/or in the voids in the middle of a sub-structure of three or more adjacent filaments.

Due to this high amount of coating and/or residual solvent, the drying and/or curing is often insufficient resulting in an inadequate adhesion of the cord to the polymer material.

Furthermore because of the presence of the high amount of coating and/or residual solvent on the filaments and/or at the interface between adjacent filaments and/or in the voids in the middle of a sub-structure created by three or more adjacent filaments the gaps between adjacent filaments are closed. Consequently, the polymer material may not penetrate between the filaments, resulting in an inadequate adhesion of the cord to the polymer material.

Furthermore, according to the present invention, the adhesion promoting coating is present at the peripheral surface of the cord, i.e. more particular on the peripheral edges of the filaments of the cord. It has been noticed by the inventors that the adhesion promoting coating applied on the peripheral surface of the cord has the biggest contribution to the adhesion of the cord to the polymer material. Adhesive applied on the core filament of the cord has a lower contribution to the adhesion of the cord to the polymer material.

According to a particular embodiment of the invention a cord as defined in claim 1 is provided. Looking at a cord of this embodiment a series of cross-sections in a plane perpendicular to the axis of the cord can be envisaged. Within such a cross-section sub-structures of three or more adjacent filaments that surround a void can be discerned. Adjacent filaments remain adjacent as the plane progresses along the axis of the cord. These sub-structures rotate on revolution for each lay length the perpendicular plane progresses along the axis of the steel cord. The presence of such sub-structures depends upon the construction of the cord.

Important for a cord according to this embodiment is that a void in the middle of three of more adjacent filaments is substantially free of said adhesion promoting coating.

A cord according to the present invention has the advantage that the amount of residual solvent at the interfaces of adjacent filaments and/or in voids of sub-structures created by three or more adjacent filaments is very limited or even completely avoided. This results in faster drying and curing and finally results in an adequate adhesion with the polymer material. This is in particular of interest for the heavy cords or cables (for example for cords or cables having a total outer diameter larger than 0.5 mm or larger than 1 mm).

Prior art cords or cables having a total outer diameter of 0.5 mm or larger than 1 mm suffer soak up significant amount of solvent and suffer from inadequate adhesion and corrosion.

The adhesion promoting coating comprises at least a first layer. The first layer comprises a silicon based coating, a titanium based coating, a zirconium based coating or a combination thereof.

A silicon based coating according to the present invention may comprise any coating comprising silicon. The silicon based coating according to the present invention is preferably selected from the group consisting of silica based coatings and silane based coatings.

For the purpose of this invention with "silica based coatings" is meant any inorganic oxide of silicon, in general denoted as $SiO_x$. Examples of silica based coatings comprise $SiO_2$ and $SiO_{1.7}$.

For the purpose of this invention with "silane based coatings" is meant any coating comprising an organofunctional silane. Preferably, the silane based coating has the following formula $$Y—R'—SiX_3$$

whereby $SiX_3$ comprises a first functional group;

R' comprises a spacer;

Y comprises a second functional group.

The first functional group $SiX_3$ is capable of binding to the cord, and more particularly to a metal filament of the cord.

X represents a silicon functional group, each of the silicon functional groups being independently selected from the group consisting of —OH, —R, —OR, —OC(═O)R and the halogens such as —Cl, —Br, —F, whereby —R is an alkyl, preferably a C1-4 alkyl, most preferably $—CH_3$ and $—C_2H_5$.

The second functional group Y is directed outward from the cord (towards the polymer material), more particularly from the metal filament of the cord, and is capable of binding to or interacting with at least one functional group of the polymer material to be reinforced. Any functional group capable of binding to or interacting with at least on functional group of the polymer material to be reinforced can be considered as second functional group Y. Examples comprise functional groups comprising at least one of the following groups: —$NH_2$, —NHR', —$NR'_2$, an unsaturated terminal double or triple carbon-carbon group, an acrylic, methacrylic acid group and its methyl or ethyl esters, —CN, —SH, an isocyanate group, a thiocyanate group and an epoxy groups.

A titanium based coating according to the present invention may comprise any coating comprising titanium. A preferred titanium based coating according to the present invention comprises a titanate.

A zirconium based coating according to the present invention may comprise any coating comprising zirconium. A preferred zirconium based coating according to the present invention comprises a zirconate.

The first layer of the adhesion promoting coating can be applied by any technique known in the art allowing the deposition of a coating layer as specified in claim 1.

The adhesion promoting coating can for example be applied by a line-of-sight technique. To provide 100% of the peripheral surface of the cord with the adhesion promoting coating it can be preferred to apply the coating by a coating technique using more than one source or using one or more moving or rotating source(s).

Preferred techniques comprise spraying such as electrostatically assisted spraying, atmospheric plasma deposition, physical vapour deposition, such as sputtering and more particularly reactive sputtering and chemical vapour deposition such as combustion chemical vapour deposition.

In electrostatically assisted spraying a coating is applied by applying a static electricity charge to the droplets of a spray and an opposite charge to the part being sprayed, which then attracts the droplets directly to its surface.

Physical vapour deposition (PVD) is a technique to deposit thin films by the condensation of a vaporized form of the material onto a substrate. The coating method involves a physical process such as high temperature evaporation or plasma sputter bombardment. In sputter deposition thin films are deposited by ejecting material from a "target", i.e. a source, which then deposits onto a substrate.

Chemical vapour deposition is a process whereby the substrate is exposed to one or more precursors (liquids or vapours), which react and/or decompose on the substrate surface to produce the desired coating. Combustion chemical vapour deposition (CCVD) involves the direct combustion of flammable liquids or vapors which contain the elements, or reagents, to be deposited on a substrate material. Organic solvents are sprayed or atomized in an oxidizing gas and burned.

The thickness of the first layer of the adhesion promoting coating is preferably less than 1 μm as for example ranging between 5 and 1000 nm. More preferably, the thickness of the first layer is ranging between 5 and 200 nm.

In a preferred embodiment of the present invention, the adhesion promoting coating comprises a second layer. The second layer is preferably applied on the edges the filaments coated with the first layer, i.e. the peripheral edges. The edges of filaments that are substantially free of said first layer remain substantially free of said second layer.

The second layer preferably comprises a silane based coating.

A preferred technique to apply the second layer of the adhesion promoting coating is by spraying such as electrostatically assisted spraying.

The thickness of the second layer of the adhesion promoting coating is preferably ranging between 100 and 1000 nm. More preferably, the thickness of the second layer of the adhesion promoting coating is ranging between 100 and 500 nm, as for example 200 nm.

Even if the adhesion promoting coating comprises a second layer, the thickness of the adhesion promoting coating is so limited that the presence of the adhesion promoting coating will not limit the possible penetration of the polymer material in the cord. This is considered as an important advantage.

A cord according to the present invention may comprise a strand, a combination of strands or a combination of at least one strand and at least one filament.

Some examples of cords comprise 3×1, 4×1, 5×1, 3×3, 7×3, 7×7, 1+6, 3+6, 3+9, 4+3, 3+5×7, 3×3, 19+8×7, 19+6×7, 7×19, 7×7, 7×7+7×19, 1+6+12, 3+9+15 and 3+9+15+18.

The description of the construction follows the sequence of manufacturing of the cord i.e. starting with the inner most filament or strand and moving outwards.

The full description of the cord is given by the following formula:

$$(N\times F)+(N\times F)+(N\times F)$$

whereby N=number of strands;

F=number of filaments.

(when N or F equals 1, they should not be included)

The construction can be completed with the diameter of the filaments and is then given by the formula:

$$(N\times F)\times D+(N\times F)\times D+(N\times F)\times D$$

whereby D=nominal diameter of filaments, expressed in mm

The cord according to the present invention comprises preferably a steel cord, i.e. a cord comprising filaments made of steel such as high carbon steel or stainless steel.

In a preferred embodiment, the filaments are made from plain carbon steel. Such a steel preferably comprises a minimum carbon content of 0.40 wt % C (for example at least 0.70 wt % C or at least 0.80 wt % C) with a maximum of 1.1 wt % C, a manganese content ranging from 0.10 to 0.90 wt % Mn, the sulphur and phosphorus contents are each preferably kept below 0.030 wt %. Additional micro-alloying elements such a chromium (up to 0.20 to 0.4 wt %), boron, cobalt, nickel, vanadium—a non-exhaustive enumeration—may also be added.

In an alternative embodiment, the filaments are made from stainless steel. Stainless steels contain a minimum of 12 wt % Cr and a substantial amount of nickel. More preferred stainless steel composition comprise are austenitic stainless steels. The most preferred compositions are known in the art as AISI (American Iron and Steel Institute) 302, AISI 301, AISI 304 and AISI 316.

The filaments have a diameter preferably ranging between 0.04 mm and 1.20 mm depending on the application. The different filaments of a cord may have the same diameter although this is not necessary.

Before the application of the adhesion promoting coating, the cord and/or the filaments and/or the strands can be uncoated or they can be coated with a suitable coating. Preferred coatings are for example zinc or zinc alloy coatings such as zinc coatings, brass coatings, zinc aluminum coatings or zinc aluminum magnesium coatings.

According to a second aspect of the present invention, a composite material comprising a cord as described above embedded in a polymer material is provided.

The polymer material can be any polymer material, for example any thermoplastic or thermosetting polymer material. Examples comprise polymers selected from the group consisting of polyvinylchlorides, polyurethanes, polyethylene terephthalate, polypropylene, modified polypropylene and polyacrylates.

According to a third aspect of the present invention, a method to manufacture a cord as described above is provided. The method comprises the steps of providing a cord, said cord comprising a number of filaments twisted together, said cord showing cross-sections wherein two adjacent filaments define an interface zone, said interface zone being defined as the zone between adjacent filaments where the distance between said adjacent filaments is the smallest, said cord having a peripheral surface, said peripheral surface of said cord being defined as the surface of the cord visible by line-of-sight inspection by an observer rotating 360° around said cord in a plane parallel to said cross-sections of said cord, said filaments having peripheral edges and/or non peripheral edges, said peripheral areas of said filaments being defined as edges being part of said peripheral surface of said cord and said non peripheral edges of said filaments being defined as edges not being part of said peripheral surface of said cord, applying on said cord a first layer of an adhesion promoting coating, said first layer comprising a silicon based coating, a titanium based coating, a zirconium based coating or a combination thereof, said adhesion promoting coating having a thickness Tx at location x, whereby peripheral edges of said filaments are coated with said adhesion promoting coating and said non peripheral edges of said filaments being substantially free of said adhesion promoting coating and whereby the thickness Tx of said adhesion promoting coating in said interface zone of adjacent filaments is not higher than the thickness Tx of said adhesion promoting coating at a location of said peripheral surface which is not in an interface zone of adjacent filaments.

In a preferred embodiment the method comprises an additional step of applying a second layer of an adhesion promoting coating on said first layer.

The first layer of the adhesion promoting coating can be applied by any technique known in the art allowing the deposition of a coating whereby the core filament of the cord is substantially free of coating.

Preferred techniques comprise techniques allowing to obtain peripheral filaments have a part coated with an adhesion promoting coating (a first part) and a part that is substantially free of said adhesion promoting coating (a second part). Such techniques comprise for example electrostatically assisted spraying and combustion chemical vapour deposition.

A preferred technique to apply the second layer of the adhesion promoting coating is by electrostatically assisted spraying.

It can be preferred that the cord is pretreated for example cleaned before the step of applying the first layer.

Furthermore, it can be preferred that the method comprises additional steps such as drying and/or curing.

BRIEF DESCRIPTION OF FIGURES IN THE DRAWINGS

Figure 1B:
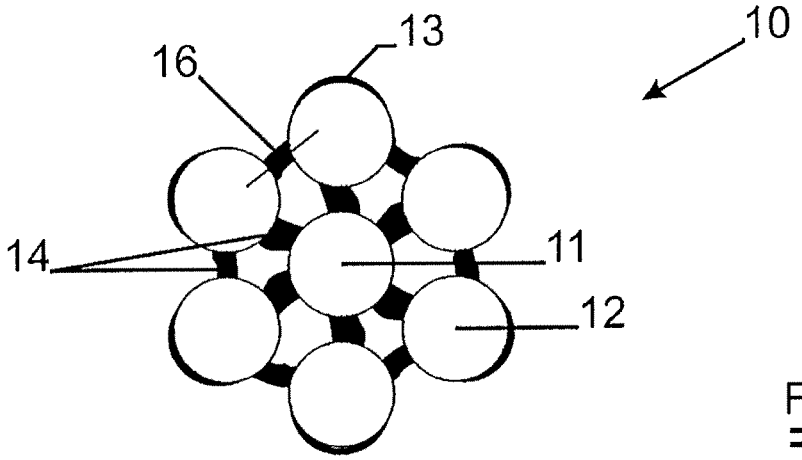
Fig. 1b Prior art
Figure 1C:
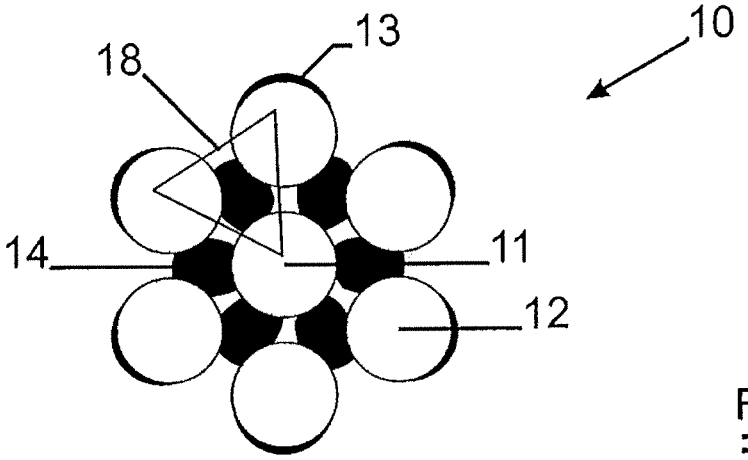
Fig. 1c Prior art

The invention will be further described into more detail with reference to the accompanying drawings wherein FIG. 1*a*, FIG. 1*b* and FIG. 1*c* show cords according to the prior art;

FIG. 2, FIG. 3, FIG. 4 and FIG. 5 show embodiments of cords according to the present invention.

MODE(S) FOR CARRYING OUT THE INVENTION

The present invention will now be described with respect to particular embodiments and with reference to certain drawings. It is clear that the invention is not limited by the embodiments or by the drawings. The drawings are only schematic and are non-limiting. In the drawings, the size of some of the elements may be exaggerated and not drawn on scale for illustrative purposes. The dimensions and the relative dimensions do not correspond to actual reductions to practice of the invention.

Examples 1a, 1b and 1c

FIG. 1*a*, FIG. 1*b* and FIG. 1*c* show cords 10 according to the prior art. The cord 10 comprises a core filament 11 and six peripheral filaments 12. The core filament 11 and the peripheral filaments 12 are steel filaments or steel filaments coated with a zinc or zinc alloy coating.

An adhesion promoting coating 14 is applied on the cord by dipping the cord in a solution. The peripheral surface of the cord 10 is coated with the adhesion promoting coating 13. The adhesion promoting coating has a thickness Tx at location x.

After drying a high amount of residual solvent 14 is present on the filaments of the cord, at the interfaces between two filaments and/or in the voids of sub-structures created by three or more adjacent filaments. Due to the high amount of residual solvent, the drying and/or curing is often insufficient, resulting in an inadequate adhesion of the cord to the polymer material.

According to the embodiment given in FIG. 1*a*, the residual solvent 14 is present at the core filament 11 and at the edges of the filaments 12 located towards the core filament 11.

According to the embodiment given in FIG. 1*b*, the residual solvent 14 is present at the interface between two adjacent filaments 16.

This leads to an adhesion promoting coating having at the interface zone between two adjacent filaments 16 a thickness $T_x$ which is higher than at other locations x (i.e. locations outside the interface zone) of the peripheral surface of the cord.

According to the embodiment given in FIG. 1*c*, the residual solvent 14 is present in the void of a sub-structure 18. The sub-structure 18 is a structure formed by three adjacent filaments.

It is clear that prior art cords combining the presence of residual solvent as given in FIG. 1*a* and/or FIG. 1*b* and/or FIG. 1*c* can also be considered.

Example 2a

Figure 2:
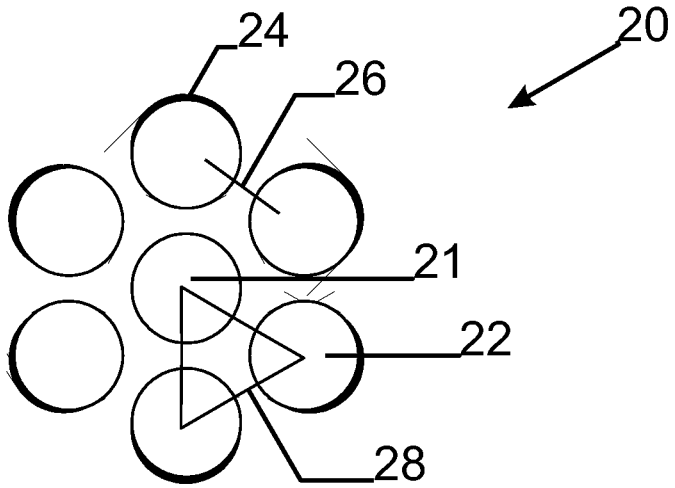

FIG. 2 shows the cross-section of a cord 20 according to the present invention. The cord 20 comprises a core filament 21 and six filaments filaments 22 around the core filament 21. The core filament 21 and the filaments 22 are steel filaments or steel filaments coated with a zinc or zinc alloy coating. The peripheral surface of the cord 20 is coated with an adhesion promoting coating 24. The adhesion promoting coating 24 is applied by electrostatically assisted spraying. The adhesion promoting coating 24 comprises for example a siliane based coating.

The core filament 21 is free of the adhesion promoting coating.

There is no accumulation of coating material at the interface zone of two adjacent filaments 26. This means that the thickness of the adhesion promoting coating 24 is at the interface of two adjacent filaments not thicker than at locations outside the interface zone of two adjacent filaments.

Furthermore, the void located in the middle of a sub-structure 28 created by three adjacent filaments is free of the adhesion promoting coating 24.

This cord has as advantage that no residual solvent is present in the core of the cord, at the interface between adjacent filaments and in the voids of sub-structures. This results in faster drying and curing and results in an improved adhesion of the cord to the polymer material.

The adhesion promoting coating 24 is so thin that the gaps between adjacent filaments present before the application of the adhesion promoting coating remain after the application of the adhesion promoting coating. These gaps allow the penetration of polymer material and consequently result in improved adhesion.

Example 2b

A further example comprises an embodiment similar as the embodiment shown in FIG. 2 but with an adhesion promoting coating 24 being applied on the cord by combustion CVD. The adhesion promoting coating 24 comprises for example $SiO_x$.

Example 3

Figure 3:
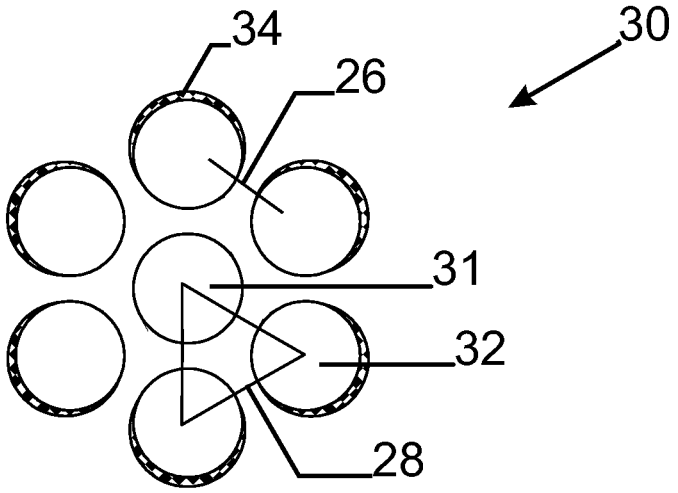

FIG. 3 shows the cross-section a further embodiment of a cord 30 according to the present invention. The cord 30 comprises a core filament 31 and six peripheral filaments 32. The core filament 31 and/or the peripheral filaments 32 are steel filaments or steel filaments coated with a zinc or zinc alloy coating.

The peripheral surface of the cord 30 is coated with and adhesion promoting coating 34. The adhesion promoting coating 34 comprises a first layer and a second layer. The first layer comprises a $SiO_x$ layer and is deposited by combustion chemical vapour deposition. The second layer comprises a silane based coating and is deposited by electrostatically assisted spraying. The thickness of the first layer is for example ranging between 5 and 200 nm; the thickness of the second layer is for example ranging between 100 and 500 nm.

The core filament 31 is free of the adhesion promoting coating.

There is no accumulation of coating material at the interface of two adjacent filaments 26. This means that the thickness of the adhesion promoting coating 34 is at the interface of two adjacent filaments not thicker than at locations outside the interface of two adjacent filaments. Furthermore, the void located in the middle of a sub-structure 28 created by three adjacent filaments is free of the adhesion promoting coating 34.

The adhesion of cords of Example 1, Example 2a and Example 3 to a polymer material is compared. The adhesion between the cord and the polymer material is determined by determining the pull out force (POF). The pull out force is determined as described below:

A cord is embedded in a polymer material. The length of the cord embedded in the polymer material is 12.7 mm. Subsequently, the cord is pulled out from the polymer material. The forces necessary to pull out the metal elements are measured. By comparing the forces needed to pull out the "adherence loss rating" is determined.

The pull out tests have been carried out according to ASTM D229-(93) "Standard test method for adhesion between steel tire cores and rubber" and according to BISFA (The International Bureau for the standardization of man-made fibres) No. E12 "Determination of static adhesion to rubber compound").

The cords of Example 1, Example 2a and Example 3 are cured in two different ways:

a. regular curing, i.e. normal curing after embedment in a matrix material;
b. hot water ageing, i.e. ageing in hot water during 88 hours at 70° C. after regular curing according to a procedure as mention in a.

The pull out force (POF) of the cord under the different ageing conditions relative to the pull out force of the cord of example 1 is given in Table 1.

TABLE 1

| Cord | Curing | POF/POF (example 1) |
|---|---|---|
| Example 1 | Regular curing | 1 |
| | Hot water ageing | 1 |
| Example 2 | Regular curing | 1.25 |
| | Hot water ageing | 1.3 |
| Example 3 | Regular curing | 1.25 |
| | Hot water ageing | 1.9 |

From Table 1 it can be concluded that a considerable increase in adhesion and hydrolysis resistance is obtained by using a cord according to the present invention.

Example 4

Figure 4:
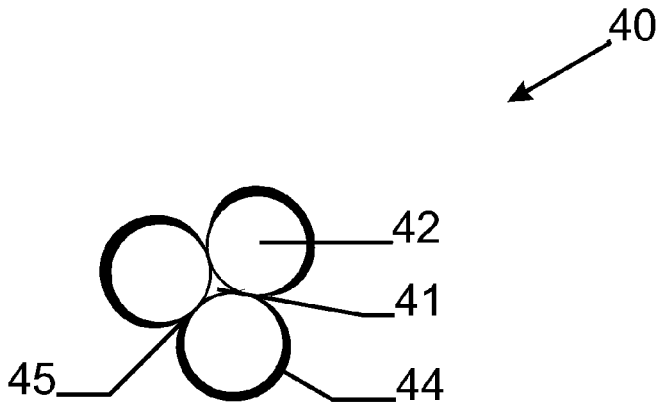

FIG. 4 shows a cord 40 according to the present invention. The cord 40 comprises three filaments 42. The filaments 42 may be coated with a zinc or zinc alloy coating.

These three filaments 42 form a sub-structure surrounding a void 41. An adhesion promoting coating 44 is applied on the cord by electrostatically assisted spraying. The adhesion promoting coating 44 comprises for example a siliane based coating.

The peripheral surface 44 is coated with an adhesion promoting coating 44.

There is no accumulation of coating material at the interface of two adjacent filaments 42. This means that the thickness of the adhesion promoting coating 44 is at the interface 45 of two adjacent filaments not thicker than at locations outside the interface of two adjacent filaments. Furthermore, the void 41 located in the middle of the three filaments 42 is free of the adhesion promoting coating.

Example 5

Figure 5:
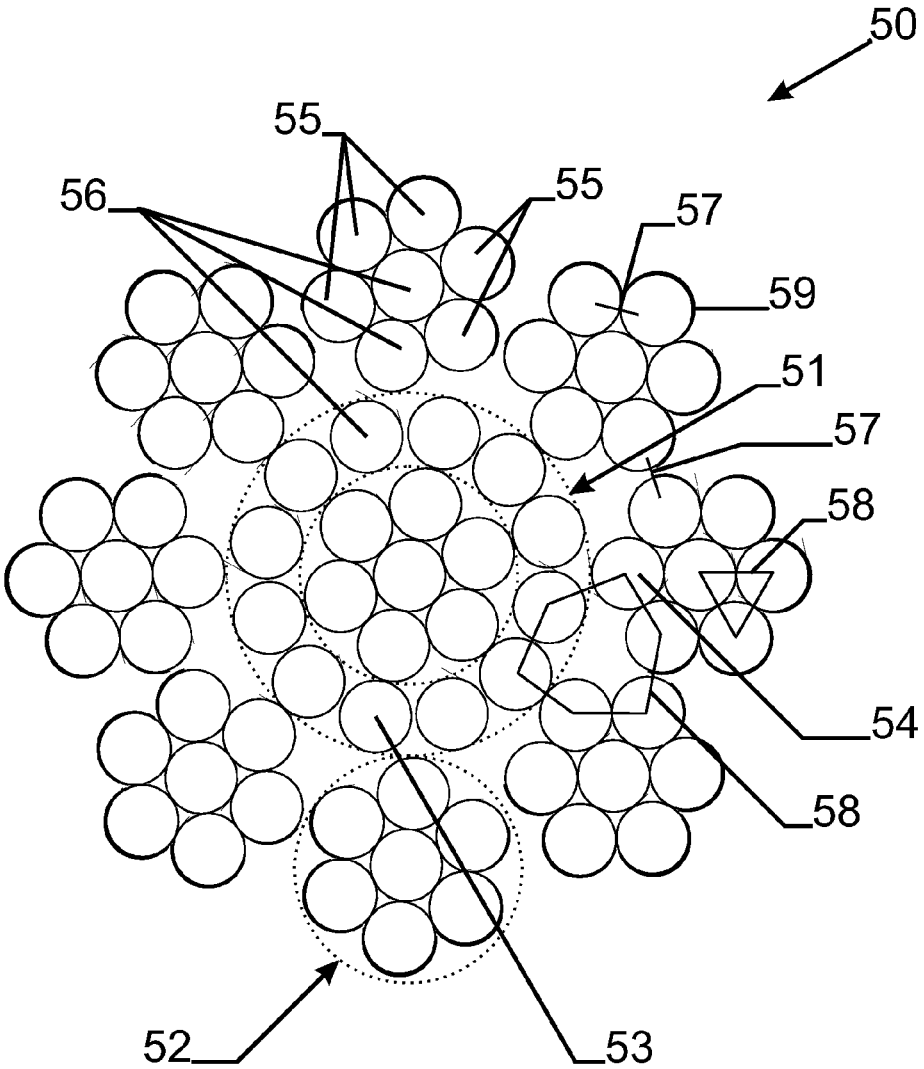

FIG. 5 shows a cord 50 according to the present invention. The construction of the cord 50 is given by the formula 19+8×7. The cord comprises a core strand 51. Around the core strand 51, the cord comprises eight strands 52. The core strand 51 comprises 19 filaments 53. The strands 52 each comprise 7 filaments 54. The filaments of the core strand 51 and of the outer strands comprise steel filaments or steel filaments coated with a zinc or a zinc alloy coating.

The peripheral surface of the cord 50 is coated with an adhesion promoting coating 59. The adhesion promoting coating 59 is applied by electrostatically assisted spraying. The adhesion promoting coating 59 comprises a first layer and a second layer. The first layer comprises a $SiO_x$ layer and is deposited by combustion chemical vapour deposition. The second layer comprises a silane based coating and is deposited by electrostatically assisted spraying. The thickness of the first layer is for example ranging between 5 and 200 nm; the thickness of the second layer is for example ranging between 100 and 500 nm.

The filaments 55 having edges that are part of the peripheral surface of the cord are at least partially coated with the adhesion promoting coating 59. More particularly, the peripheral edges of these filaments 55 are coated.

Filaments 58 not having edges that are part of the peripheral surface of the cord are free of the adhesion promoting coating 59.

There is no accumulation of coating material at the interface of two adjacent filaments 57. This means that the thickness of the adhesion promoting coating 59 is at the interface of two adjacent filaments not thicker than at locations outside the interface of two adjacent filaments. Furthermore, the void located in the middle of sub-structures 57 created by three or more adjacent filaments is free of the adhesion promoting coating 24.

This cord has as advantage that no residual solvent is present in the core of the cord, at the interface between adjacent filaments and in the voids of sub-structures. This results in faster drying and curing and results in an improved adhesion of the cord to the polymer material.

The adhesion promoting coating 59 is so thin than the gaps between adjacent filaments present before the application of the adhesion promoting coating remain after the application of the adhesion promoting coating. These gaps allow the penetration of polymer material and consequently result in improved adhesion.

The invention claimed is:

1. A composite material comprising a cord embedded in a polymer material, said cord comprising a number of filaments twisted together, said cord being partially coated with an adhesion promoting coating configured to provide adhesion between said cord and said polymer material, said cord comprising:

a core strand comprised of a plurality of core strand filaments, said core strand filaments being substantially free of said adhesion promoting coating; and a plurality of peripheral strands arranged around said core strand, each of said peripheral strands being comprised of peripheral filaments and non-peripheral filaments, said peripheral filaments being coated with said adhesion promoting coating and said non-peripheral filaments being substantially free of said adhesion promoting coating, said cord showing cross-sections in a plane perpendicular to an axis of said cord wherein two adjacent filaments define an interface zone, said interface zone being defined as a zone between adjacent filaments where a distance between said adjacent filaments is smallest, said peripheral filaments having peripheral edges and non-peripheral edges, said peripheral edges of said peripheral filaments being defined as edges being part of an exterior surface of a peripheral strand and said non-peripheral edges of said peripheral filaments being defined as edges not being part of said exterior surface of said peripheral strand, said peripheral edges of said peripheral filaments being coated with said adhesion promoting coating and said non-peripheral edges of said peripheral filaments being substantially free of said adhesion promoting coating, said adhesion promoting coating having a thickness Tx at location x, the thickness Tx of said adhesion promoting coating in said interface zone of adjacent filaments is not higher than the thickness Tx of said adhesion promoting coating at a location of said exterior surface which is not in one of said interface zones of adjacent filaments, said adhesion promoting coating comprising at least a first layer, said first layer comprising a silicon based coating, a titanium based coating, a zirconium based coating or a combination thereof, and said first layer is an electrostatically-assisted-spray coating applied by electrostatically assisted spraying.

2. A composite material according to claim 1, wherein three or more adjacent filaments in said cross-sections define a sub-structure, said sub-structure defining a void in the middle of said three or more filaments, said void being substantially free of said adhesion promoting coating.

3. A composite material according to claim 1, wherein said silicon based coating is selected from the group consisting of silica based coatings and silane based coatings.

4. A composite material according to claim 1, wherein said adhesion promoting coating further comprises a second layer, said second layer being deposited on said first layer and said second layer leaving said non-peripheral edges of said peripheral filaments substantially free of said adhesion promoting coating.

5. A composite material according to claim 4, wherein said second layer of said adhesion promoting coating is selected from the group consisting of silane based coatings.

6. A composite material according to claim 5, wherein said second layer is applied by electrostatically assisted spraying.

7. A composite material according to claim 1, wherein said filaments are made of steel.

8. A composite material according to claim 2, wherein said cord, said filaments, or a combination thereof are coated with a zinc or zinc alloy coating.

9. A method to manufacture a composite material as defined in claim 1, said method comprising the steps of:

providing a cord, said cord comprising a core strand comprised of a plurality of core strand filaments, said core strand filaments being substantially free of adhesion promoting coating, and a plurality of peripheral strands arranged around said core strand, each of said peripheral strands being comprised of peripheral filaments and non-peripheral filaments, said peripheral filaments being coated with said adhesion promoting coating and said non-peripheral filaments being substantially free of said adhesion promoting coating, said cord showing cross-sections in a plane perpendicular to an axis of said cord, wherein two adjacent filaments define an interface zone, said interface zone being defined as the zone between adjacent filaments where the distance between said adjacent filaments is the smallest, said peripheral filaments having peripheral edges and non-peripheral edges, said peripheral edges of said peripheral filaments being defined as edges being part of an exterior surface of a peripheral strand and said non-peripheral edges of said peripheral filaments being defined as edges not being part of said exterior surface of said peripheral strand, and applying on said cord a first layer of said adhesion promoting coating by electrostatically assisted spraying, said first layer comprising a silicon based coating, a titanium based coating, a zirconium based coating or a combination thereof, said adhesion promoting coating having a thickness Tx at location x, wherein said peripheral edges of said peripheral filaments are coated with said adhesion promoting coating and said non-peripheral edges of said peripheral filaments are substantially free of said adhesion promoting coating, and wherein the thickness Tx of said adhesion promoting coating in said interface zone of adjacent filaments is not higher than the thickness Tx of said adhesion promoting coating at a location of said peripheral edges which is not in an interface zone of adjacent filaments.

10. A method according to claim 9, wherein said method comprises a further step of applying a second layer of an adhesion promoting coating on said first layer.

11. A composite material according to claim 1, wherein the electrostatically assisted spraying comprises applying a static electricity charge to droplets of a spray of said first layer and an opposite charge to said cord such that the opposite charge of said cord attracts said droplets of said spray of said first layer directly to said peripheral edges of said peripheral filaments.

12. A composite material according to claim 1, wherein a thickness of said adhesion promoting coating ranges from 5 nm to 5000 nm.

13. A composite material according to claim 1, wherein said polymer material is selected from the group consisting of polyvinylchloride, polyurethane, polyethylene terephthalate, polypropylene, modified polypropylene and polyacrylate.

14. A composite material according to claim 1, wherein said polymer material and said adhesion promoting coating are different materials.

15. A method according to claim 9, wherein the electrostatically assisted spraying comprises applying a static electricity charge to droplets of a spray of said first layer and an opposite charge to said cord such that the opposite charge of said cord attracts said droplets of said spray of said first layer directly to said peripheral edges of said peripheral filaments.

* * * * *